US009451839B2

(12) United States Patent
Regan et al.

(10) Patent No.: US 9,451,839 B2
(45) Date of Patent: Sep. 27, 2016

(54) COMFORTER WITH FITTED BORDER

(75) Inventors: Laura A. Regan, Bothell, WA (US); Tamara Soreano, Shoreline, WA (US)

(73) Assignee: Pacific Coast Feather Company, Seattle, WA (US)

( * ) Notice: Subject to any disclaimer, the term of this patent is extended or adjusted under 35 U.S.C. 154(b) by 0 days.

(21) Appl. No.: 13/442,608

(22) Filed: Apr. 9, 2012

(65) Prior Publication Data

US 2013/0263375 A1 Oct. 10, 2013

(51) Int. Cl.
*A47G 9/02* (2006.01)
*A47G 9/00* (2006.01)

(52) U.S. Cl.
CPC ..... *A47G 9/0223* (2013.01); *A47G 9/0207* (2013.01)

(58) Field of Classification Search
CPC .... A47C 31/105; A47C 27/002; A47G 9/00; A47G 9/02; A47G 9/0207; A47G 9/0223; A47G 9/0238; A47G 9/0261; A47G 9/0292
USPC ..... 5/500, 502, 482, 486, 493, 499, 485, 5/691
See application file for complete search history.

(56) References Cited

U.S. PATENT DOCUMENTS 1,583,334 A * 5/1926 Bloom ..... A47C 27/121 5/502
2,596,547 A * 5/1952 Guest ..... A47G 9/0207 5/485
3,467,974 A * 9/1969 Deutsch ..... A47G 9/0207 5/496
3,621,498 A * 11/1971 Cooper ..... A47G 9/0284 5/174
4,274,169 A * 6/1981 Standiford ..... A47G 9/0207 5/482
5,199,121 A * 4/1993 Payne ..... 5/502
5,299,333 A * 4/1994 Pedersen et al. ..... 5/502
5,720,058 A * 2/1998 Hollander ..... A47G 9/0207 5/486
D392,497 S * 3/1998 Mansfield ..... D6/603
D395,187 S * 6/1998 Mansfield ..... D6/603
D395,974 S * 7/1998 Mansfield ..... D6/603
D397,578 S * 9/1998 Mansfield ..... D6/603
D409,873 S * 5/1999 Johnson ..... D6/603
6,115,859 A * 9/2000 Ozawa ..... A47C 27/12 112/441
7,467,429 B2 * 12/2008 Soreano ..... A47C 27/124 112/420
7,647,657 B2 * 1/2010 Delfs ..... A47G 9/0207 112/420
8,561,229 B2 * 10/2013 Regan ..... A47G 9/0207 5/482
9,089,228 B2 * 7/2015 Shattuck ..... A47G 9/0223
2004/0031098 A1 * 2/2004 Hollander ..... 5/482
2006/0272094 A1 * 12/2006 Boyd ..... 5/502
2008/0189857 A1 * 8/2008 Delfs ..... 5/502
2008/0201846 A1 * 8/2008 Soreano ..... A47C 27/124 5/502
2011/0047699 A1 * 3/2011 Regan et al. ..... 5/502
2011/0314605 A1 * 12/2011 Deguchi ..... 5/501
2012/0186014 A1 * 7/2012 Shattuck et al. ..... 5/485
2013/0263375 A1 * 10/2013 Regan ..... A47G 9/0223 5/500

* cited by examiner

*Primary Examiner* — Robert G Santos
(74) *Attorney, Agent, or Firm* — Clark A. Punitgam; Jensen & Puntigam, P.S.

(57) ABSTRACT

The comforter includes a core portion which has dimensions approximately the same as the top of the mattress on which it is to be placed. A border member portion is attached to two longitudinal sides and a foot end of the comforter. The border member comprises two layers of fabric with little or no fill therebetween, with the inner edges thereof attached to the core portion and the outer edges attached together.

8 Claims, 2 Drawing Sheets

COMFORTER WITH FITTED BORDER

TECHNICAL FIELD

This invention relates generally to comforters and in more detail concerns a comforter with a particular border arrangement.

BACKGROUND OF THE INVENTION

Comforters are typically sized and constructed to lie atop a mattress/bed and to extend a distance over the sides and foot of the bed. While conventional, this configuration does have some disadvantages, since the overall size of the comforter relative to the size of the mattress results in making the bed less convenient, and excess fabric at the foot corners of the bed can reduce the otherwise neat appearance of the bed. In addition, a duvet cover is often used with a comforter, which further impacts the appearance of the bed and making of the bed.

Accordingly, from the above, it would be desirable to have a comforter with a different configuration and/or structure which results in a neater and more stable appearance of the comforter on the bed, and such that making of the bed is more convenient.

SUMMARY OF THE INVENTION

Accordingly, the comforter comprises: a core portion, having selected dimensions, approximately the same as the top of the mattress on which it is to be placed; and a border member, attached to the core portion along three sides of the core portion including two sides of the core portion and a foot end portion thereof, wherein the border member comprises two layers of fabric with little or no fill therebetween, and otherwise adapted and sized to lay against the side of the mattress on which the comforter is placed.

BEST MODE FOR CARRYING OUT THE INVENTION

Figure 1:
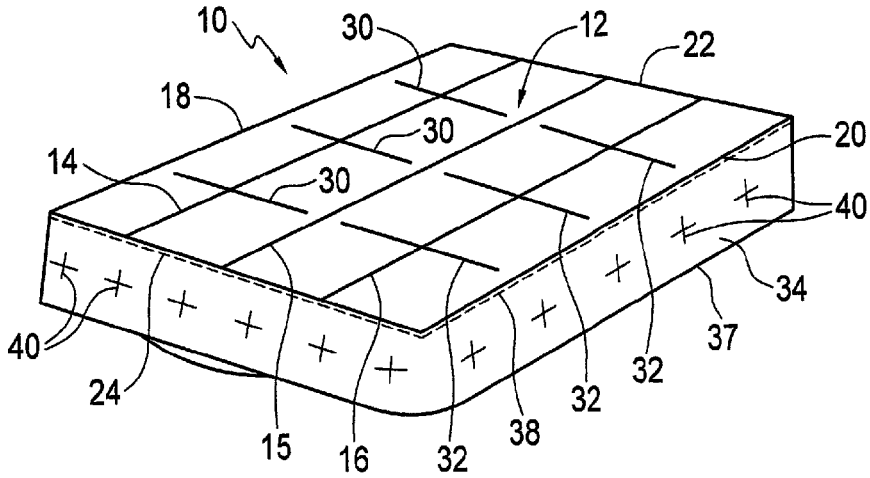
FIG. 1 is a perspective view of one embodiment of a new comforter described and claimed herein.
Figure 2:
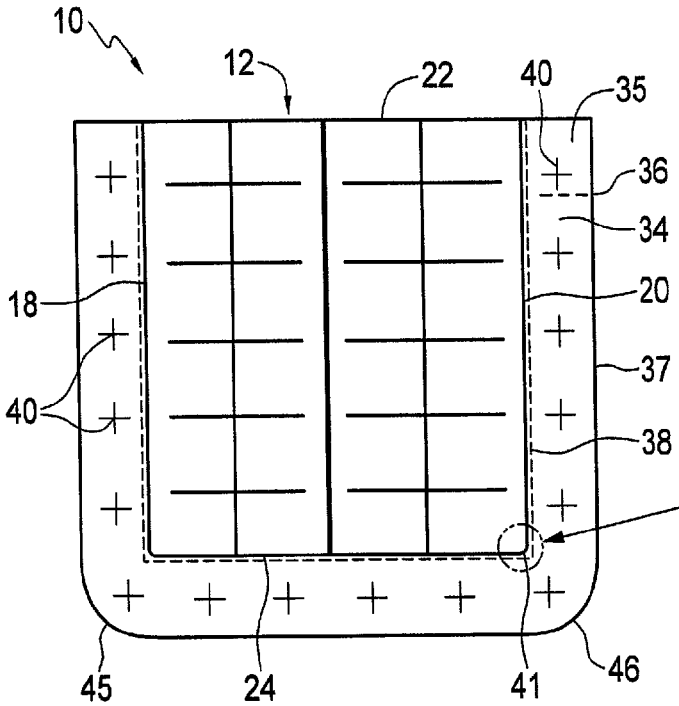
FIG. 2 is a top view of a variation of the comforter of FIG. 1.
Figure 3:
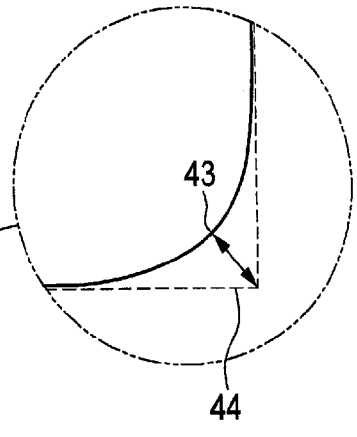
FIG. 3 is a top view of a portion of the comforter of FIGS. 1 and 2.

FIGS. 1-3 show a first embodiment of a new comforter, referred to generally at 10. The comforter includes a core portion 12 which is the central portion of comforter 10 and has a size which is approximately equal to the size of the mattress on which the comforter is to be placed. The core portion is defined by side edges 18 and 20, head end edge 22 and foot end edge 24. The comforter shown in FIGS. 1-3 is a baffle box comforter. In the particular arrangement of FIGS. 1-3, it includes multiple longitudinal baffles (three baffles 14-16 are shown in FIG. 1) which extend the length of the core portion. The core portion further includes a set of lateral baffles 30-30 (three are shown in FIG. 1, while more are shown in FIG. 2) located on one side of the comforter, extending across longitudinal baffle 14. There is a space between the ends of lateral baffles 30-30 and longitudinal baffle 15 and side edge 18, respectively. There is a similar set of lateral baffles 32-32 for the other side of the comforter. The number and arrangement of the longitudinal and lateral baffles can vary depending upon the particular design of the comforter and the size of the comforter.

Attached to side edges 18 and 20 and foot end edge 24 of the core portion 10 is a border member 34. Border member 34 comprises two layers 35, 36 of fabric sewn together along the respective outer edges 37 thereof, and also sewn along inner edges 38 thereof to the side edges and the foot end edge of the core portion of the comforter. The border member 34 in the embodiment shown has 1.5 inch sewn-through tacks 40, spaced along the entire length of the border member. In the embodiment shown, the separation between adjacent tacks 40 is 10 inches. The tacks adjacent the ends of the border member are located approximately 5 inches from said ends.

The border member typically has some fill between the two layers 35, 36, usually a lighter fill than the core portion, although no fill can be used without departing from the spirit of the invention. The corners 41 of the core portion 12 at the foot end of the comforter are curved, as shown most clearly in FIG. 3, with the curve being so that there is approximately 2 inches between the curved corner edge 43 of the core portion and a straight line corner, as shown in dotted lines at 44. The outboard foot corners 45, 46 of the border member follow the curved corners of the core portion, which makes the border curve around the side edge of a mattress when placed on a bed, as shown most clearly in FIG. 2.

The structure of FIGS. 1-3, in particular the structure of the border member, overcomes the disadvantages of conventional comforters noted above. With the present comforter, when it is placed on a bed, the fitted border member extends downwardly closely adjacent the sides and foot end edges of the mattress. When so placed on the bed, it will typically remain in place, an important functional and appearance advantage. The bed is also more convenient to make with the present comforter. The corners of the present comforter, because of the border structure and configuration, are neat and tailored looking, compared with a traditional comforter with its square corners and resulting excess fabric. The structure of the present comforter also eliminates the need for a separate duvet cover. Still further, since the fill of the comforter is concentrated in the core area, and the core area will generally match the size of the mattress, there will be no migration of fill from the top of the bed into the border regions along the sides of the mattress, since the core area is sewn closed to the border member.

Figure 4:
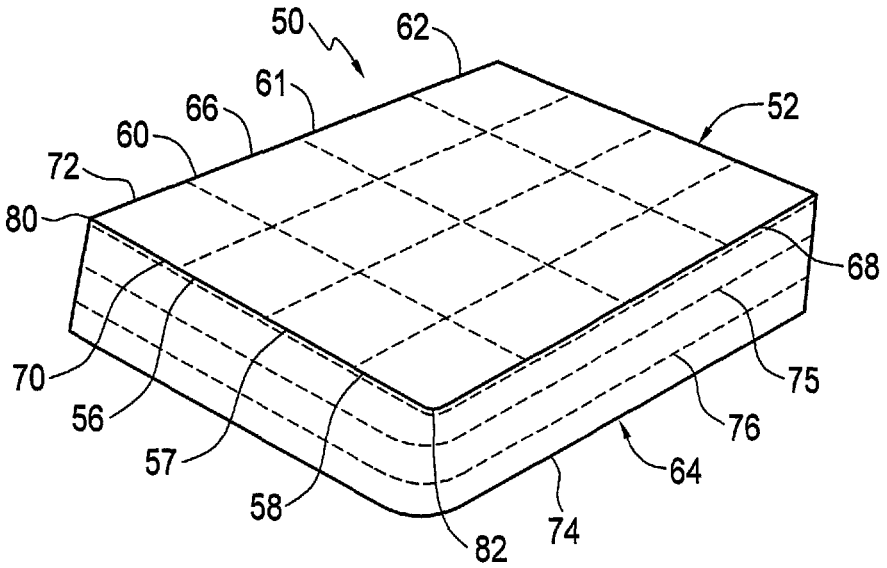
FIG. 4 is a perspective view of another embodiment of the new comforter.
Figure 5:
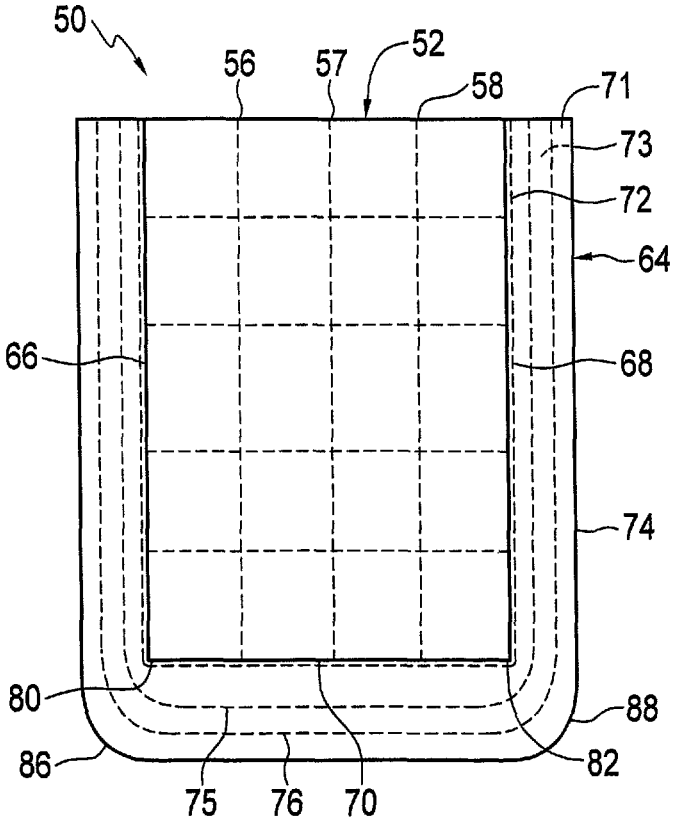
FIG. 5 is a top view of a variation of the embodiment of FIG. 4.

FIGS. 4 and 5 show another comforter configuration, with a sewn-through construction, as opposed to a baffle construction. The comforter, referred to generally at 50, includes a core portion 52 which comprises two layers of fabric with fill positioned therebetween. The comforter 50 is referred to as a sewn-through comforter, since it includes three longitudinal lines of sewing 56-58 (FIGS. 4 and 5) and three lateral lines of sewing 60-62 (FIG. 4) defining in the embodiment of FIG. 4 shown a total of 16 individual boxes. FIG. 5, which is a variation of FIG. 4, includes 4 lateral lines of sewing, resulting in 20 individual boxes. The arrangement of FIGS. 4 and 5 is one example only of a sewn-through comforter. Different size comforters, for instance, will have different sewn-through patterns. Comforter 50 includes a border member 64 which extends around three sides of the core portion of the comforter, namely sides 66 and 68 and foot end 70 thereof. The border member is continuous and comprises two layers of fabric 71, 73 attached together along inboard edges 72 thereof to the sides and foot end of the core member. The outboard edges 74 of the two layers 64 are also sewn together.

In the embodiment shown, border member 64 is 13 inches wide, although this can vary. The number of boxes and lines of stitching will vary depending upon the size of the comforter, as mentioned above. In the embodiment of FIGS. 4 and 5, two spaced lines of stitching 75 and 76 extend along the entire length of the border, dividing the border member into three equal sized sections from top to bottom of the border member. The position of the lines of stitching, however, can vary.

As with the embodiment of FIGS. 1-3, the foot end corners 80, 82 of the core portion 52 are curved, as are the corners 86, 88 of the border member. Like the comforter of FIGS. 1-3, the border member 64 lies flat against the sides of the mattress when the comforter is positioned on the bed, so that the bed is more convenient to make, with a neater appearance than with conventional comforters.

Accordingly, a new comforter has been disclosed having a slightly filled or in some cases a non-filled border member with a particular arrangement and configuration which results in significant advantages in use and appearance over a conventional comforter.

Although a preferred embodiment of the invention has been disclosed for purposes of illustration, it should be understood that various changes, modifications and substitutions may be incorporated in the embodiment without departing from the spirit of the invention, which is defined by the claims which follow.

What is claimed is:

1. A comforter, comprising:

a core portion, having selected dimensions, approximately the same as the top of the mattress on which it is to be placed, wherein the core portion has a baffle box structure or a sewn through structure with loose fill positioned therein; and a border member, comprising two layers of fabric sewn together along their respective outer edges, separated initially from the core portion and then sewn permanently closed to the core portion, along their respective inner edges, to only three sides of the core portion, including two sides of the core portion and a foot end portion thereof, to form the comforter, in such a manner that there is no migration of fill from the core portion into the border member, wherein the border member has no fill therein, and is otherwise continuously vacant so as to be adapted and sized to lay against the side of the mattress on which the comforter is placed.

2. The comforter of claim 1, wherein the border member is continuous.

3. The comforter of claim 1, including a plurality of spaced stitching tacks positioned along the length of the border member.

4. The comforter of claim 1, including continuous lines of stitching positioned along the length of the border member.

5. The comforter of claim 1, wherein the core portion has corners at the foot end thereof which are curved.

6. The comforter of claim 5, wherein the border member has curved corners at the foot end thereof.

7. The comforter of claim 1, wherein the core portion has a baffle box structure.

8. The comforter of claim 1, wherein the core portion has a sewn-through structure.

* * * * *